US005643064A

United States Patent [19]

Grinderslev et al.

[11] Patent Number: 5,643,064

[45] Date of Patent: Jul. 1, 1997

[54] UNIVERSAL POLISHING FIXTURE FOR POLISHING OPTICAL FIBER CONNECTORS

[75] Inventors: Soren Grinderslev, Hummelstown; Nancy Lebeis Miller, Harrisburg; Randall B. Paul, Elizabethville, all of Pa.

[73] Assignee: The Whitaker Corporation, Wilmington, Del.

[21] Appl. No.: 668,028

[22] Filed: Jun. 19, 1996

Related U.S. Application Data

[60] Provisional application No. 60/003,494 Sep. 8, 1995.

[51] Int. Cl.[6] ..... B24B 19/00

[52] U.S. Cl. ..... 451/378; 451/386; 451/391; 451/41; 269/229; 269/287

[58] Field of Search ..... 451/378, 51, 367, 451/386, 391, 41, 42, 43, 369, 370, 384; 269/229, 233, 235, 287

[56] References Cited

U.S. PATENT DOCUMENTS

| | | | |
|---|---|---|---|
| 4,693,035 | 9/1987 | Doyle | 51/125 |
| 4,819,386 | 4/1989 | Struyf | 451/28 |
| 4,831,784 | 5/1989 | Takahashi . | |
| 4,905,415 | 3/1990 | Moulin . | |
| 5,109,460 | 4/1992 | Baek et al. . | |
| 5,140,779 | 8/1992 | Grois | 451/386 |
| 5,216,846 | 6/1993 | Takahashi . | |
| 5,321,917 | 6/1994 | Franklin et al. | 451/386 |

FOREIGN PATENT DOCUMENTS

| | | | |
|---|---|---|---|
| 0 579 056 A1 | 1/1994 | European Pat. Off. . | |
| 0 621 107 A1 | 10/1994 | European Pat. Off. . | |
| 0 657 247 A2 | 6/1995 | European Pat. Off. . | |
| 61-113005 | 5/1986 | Japan | G02B 6/00 |
| 2 272 658 | 5/1994 | United Kingdom | B24B 19/22 |
| WO96/14960 | 5/1996 | WIPO | B24B 19/22 |

OTHER PUBLICATIONS

PCT International Search Report; International Application No. PCT/US96/14361; International Filing Date May 9, 1996.

SFP–550 PAC Polishing Machine Operating Manual; 22 Pages.

Seikoh Giken SFP–70D Polishing Machine For PC and PAC Connector Operating Manual; 28 Pages.

JDS Fitel, SFP–550 PAC Polishing Machine, 23 Mar., 1993.

Seikoh Giken SFP–70D Polishing Machine for PC and PAC Connectors Nov. 1994.

*Primary Examiner*—Robert A. Rose
*Assistant Examiner*—George Nguyen

[57] ABSTRACT

A polishing fixture (20) for use with a polishing machine comprises a plurality of clamping assemblies (41) (22). The fixture (20) includes a connector holder plate (28) which has a perimeter edge (30). A plurality of slots (42) obliquely extend inwardly from the perimeter edge (30) through the plate (28). A force transmitting body (26) having an internal rim (32) is positioned around the perimeter edge (30) of the connector holder plate (28) so as to provide a camming action against convex cam surfaces (52). The camming action of the internal rim (32) of the force transmitting body (26) and the convex cam surface (52) on the perimeter (30) of the connector holder plate (28) deflect a corresponding beam (44) inwardly to clamp a connector (49) positioned in a corresponding one of the camping assemblies (41).

25 Claims, 7 Drawing Sheets

UNIVERSAL POLISHING FIXTURE FOR POLISHING OPTICAL FIBER CONNECTORS

This application claims the benefits of Provisional Application No. 60/003,494, filed Sep. 8, 1995.

BACKGROUND

The present invention relates to tooling or fixtures for use with a polishing machine to secure a plurality of articles such as optical fiber connectors in the fixture to position such articles for precision polishing procedures.

Optical fiber connectors are a critical link in any fiber optic transmission system. Optical fiber connectors provide a mechanical link between two ends of optical fibers thereby permitting transmission through the connector. Due to the characteristics of optical fiber transmission systems, it is important that the connecting end of the fiber connector satisfy high precision standards in order to prevent signal degradation.

With the increasing importance of optical fiber transmission systems comes the increasing importance of the connector assembly. Connector and cable assemblies must be prepared more quickly and in larger quantities than ever before. Prior art polishing systems employed large, generally rectangular connector polishing fixtures which position the connectors over the polishing surface of the polishing machine. The fixtures typically accommodate multiple positions of a single connector style and require substantial set up time to position and secure the connectors to the fixture.

A single polishing operation is time consuming and the polishing machine may be expensive. It is important, therefore, to maximize the efficiency of each polishing operation. If a polishing operation is initiated with less than all of the positions on a fixture being filled, the empty connector positions effectively reduce the efficiency of the operation and increase the cost of the polishing operations.

In certain applications optical fiber connectors are terminated and polished at a field location and out of the controlled manufacturing environment. Polishing operations may require the polishing of a variety of styles of connectors in order to complete a job. By using fixtures which are dedicated to a specific style of connector, a person operating in the field must carry multiple fixtures, a fixture for each variety of connector style which they may encounter. The necessity to carry multiple fixtures lowers field termination efficiency and increases the cost of the field operations.

Another problem with multiple fixtures is that such fixtures can be expensive when they are not mass produced, each fixture style requiring a different manufacturing process. Accordingly, the low volume manufacturing of each fixture style increases the cost of each fixture and may prevent realizing manufacturing economies of scale. A reduction in cost might be accomplished by providing a mass produced universal fixture which will accommodate a variety of connector geometries.

In use, many polishing fixtures require individual set-up of each connector in a corresponding nest. Such set-up requires positioning the connector in the nest and then clamping the associated clamping mechanism to retain the connector therein. While this may be a desirable operation under some circumstances, there are circumstances in which it may be preferable to provide a single clamping step to reduce the time associated with the set-up procedure.

OBJECTS AND SUMMARY

A general object satisfied by the claimed invention is to provide a clamping fixture for use with a polishing machine which accommodates a variety of articles geometries on a single fixture.

Another object satisfied by the claimed invention is to provide an optical fiber connector fixture which is capable of holding a variety of optical fiber connector geometries and which securely position the clamped connectors on a polishing machine.

Still another object of the present invention is to provide a polishing fixture which simultaneously clamps a plurality of articles in clamping assemblies.

Yet a further object satisfied by the present invention is to provide a polishing fixture which simultaneously clamps a plurality of connectors in clamping assemblies in which it captivates the connectors prior to imposing clamping forces thereon.

Briefly, and in accordance with the foregoing, the present invention envisions a polishing fixture for use with a polishing machine. The polishing machine polishes end portions of articles which are retained in the fixture by clamping a portion of the article in a clamping assembly. The fixture is used to retain articles such as optical fiber connector by clamping a ferrule portion in the clamping assembly to securely hold the ferrule for polishing an end thereof. The fixture includes a connector holding plate which has a perimeter edge. A plurality of slots obliquely extend inwardly from the perimeter edge through the plate. A deflectable beam is defined between each of the plurality of slots and a corresponding portion of the perimeter edge. At least one convex cam surface is disposed on the perimeter edge proximate each of the beams. A force transmitting body having an internal rim is positioned around the perimeter edge of the connector holding plate so as to provide a camming action against the convex cam surfaces. The camming action of the internal rim of the force transmitting body and the convex cam surface on the perimeter of the connector holding plate deflect the corresponding beam inwardly to clamp a connector positioned in a corresponding one of the slots.

BRIEF DESCRIPTION OF THE DRAWINGS

The organization and manner of the structure and function of the invention, together with further objects and advantages thereof, may be understood by reference to the following description taken in connection with the accompanying drawings, wherein like reference numerals identify like elements, and in which.

DESCRIPTION

Figure 1:
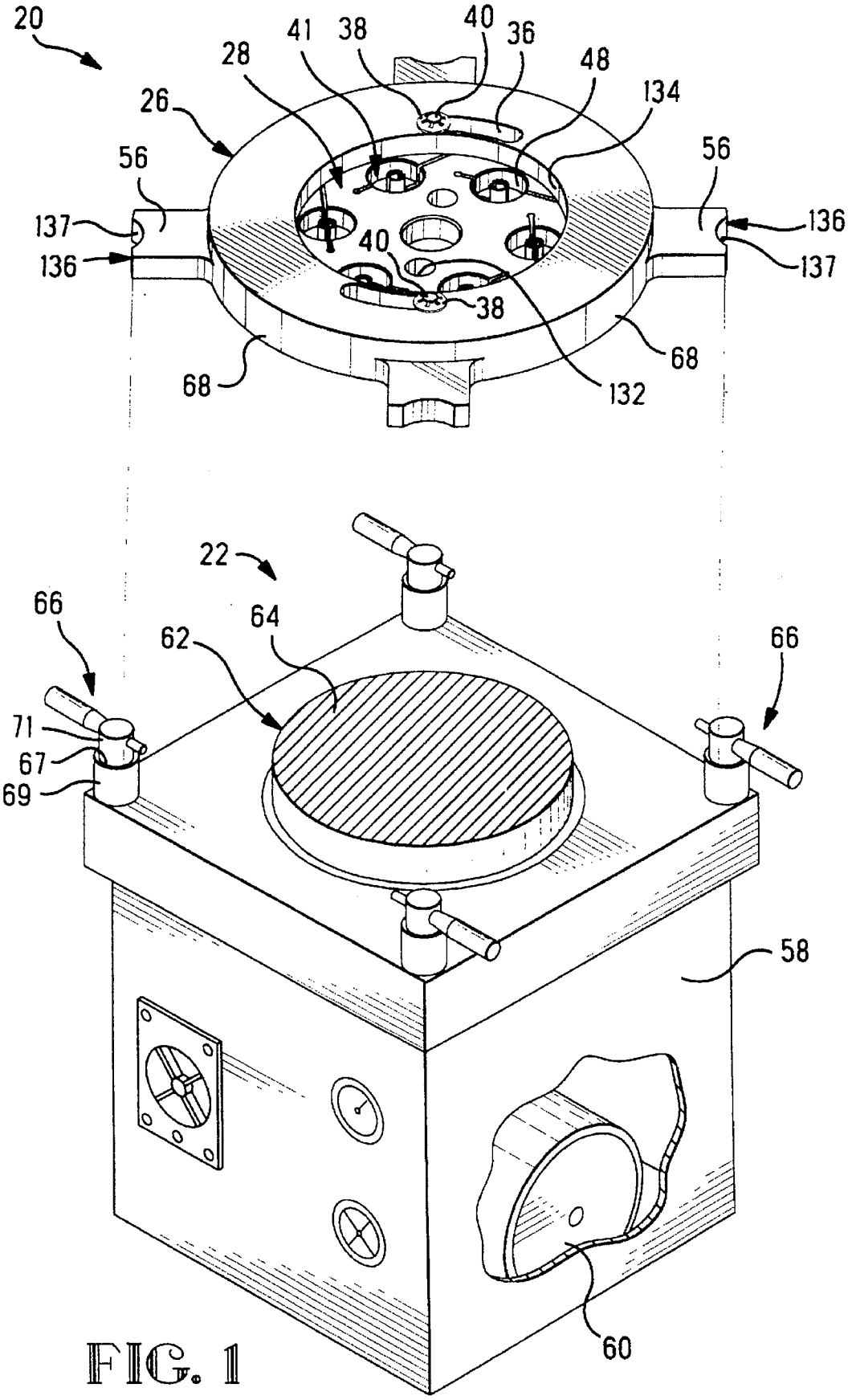
FIG. 1 is an exploded perspective view of a universal polishing fixture of the present invention positioned for engagement with a polishing machine.

While the present invention may be susceptible to embodiment in different forms, there is shown in the drawings, and herein will be described in detail, an embodiment with the understanding that the present description is to be considered an exemplification of the principles of the invention and is not intended to limit the invention to that as illustrated and described herein.

Figure 2:
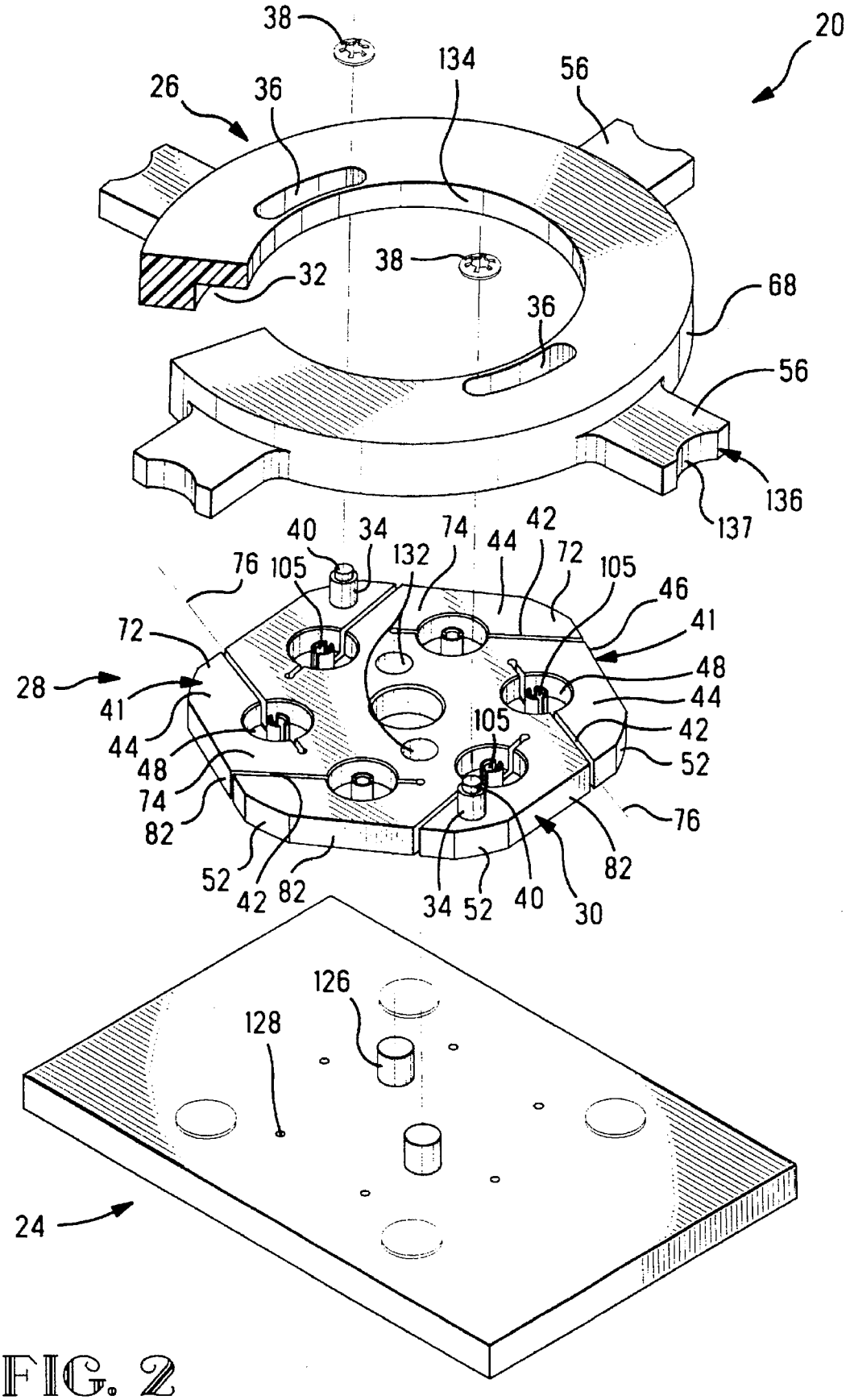
FIG. 2 is an exploded perspective view of the universal polishing fixture as shown in FIG. 1 illustrating a cam ring separated from a holder plate and in which both the cam ring and holder plate are positioned above a set up plate used to position connectors in the holder plate.
Figure 3:
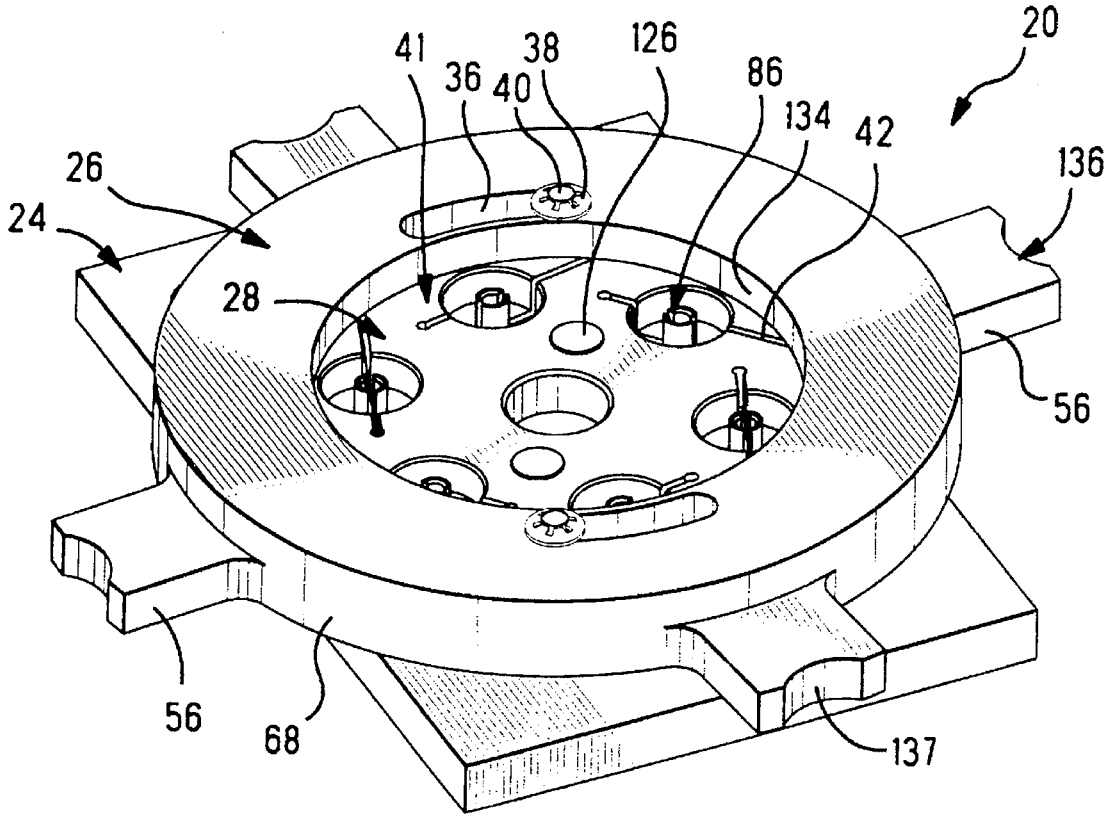
FIG. 3 is a perspective view of the cam ring and the holder plate on the set up plate and in which the cam ring is positioned to disengage the clamping assemblies.

With reference to FIG. 1, a polishing fixture 20 of the claimed invention is shown displaced upwardly away from a polishing machine 22 with which the fixture 20 is used. FIG. 2 shows an exploded view of the fixture 20 as shown in FIG. 1 positioned above a set up plate 24 which is used to arrange connectors in the fixture as will be described in further detail hereinbelow. In the exploded view of FIG. 2, it can be seen that the fixture includes a force transmitting body or cam ring 26 and a connector holder plate 28. The holder plate 28 has a generally polygonal outer contour with a perimeter 30 which mates with a corresponding internal rim 32 (shown in greater detail in FIGS. 4 and 5) on the cam ring 26.

Attachment posts 34 extend upwardly from the plate 28 through elongated apertures 36 formed in the cam ring 26. Retainers 38 are attached to ends 40 of the attachment posts 34 to retain the cam ring 26 and connector holder plate 28 in assembly. The retainers 38 connect to the attachment posts 34 and have a flange portion which extends radially outwardly generally overlying a corresponding surface of the ring 26. The retainers 38 overly the ring 26 with sufficient clearance to allow movement of the ring 26 relative to the holder plate 28. Retention of the ring 26 on the holder plate 28 may also be achieved by deforming, heat staking the ends 40 or by inserting an appropriate mechanical fastener on the ends 40 to provide the overlying flange structure as described above to retain the ring 26 in relation to the holder plate 28 and allow a degree of rotational movement of the cam ring 26 relative to the plate 28 with the posts traveling in the elongated apertures 36.

With reference to FIGS. 1–6, a plurality of clamping assemblies 41 are regularly arranged around a circumferential area of the holder plate. Each clamping assembly 41 includes a plurality of slots 42 formed in the connector holder plate 28 which define a beam 44 cantilevered from the circumferential area of the holding plate between the slot 42 and a corresponding portion 46 of the perimeter 30. The slots 42 extend from the perimeter 30 generally obliquely and inwardly.

Figure 10:
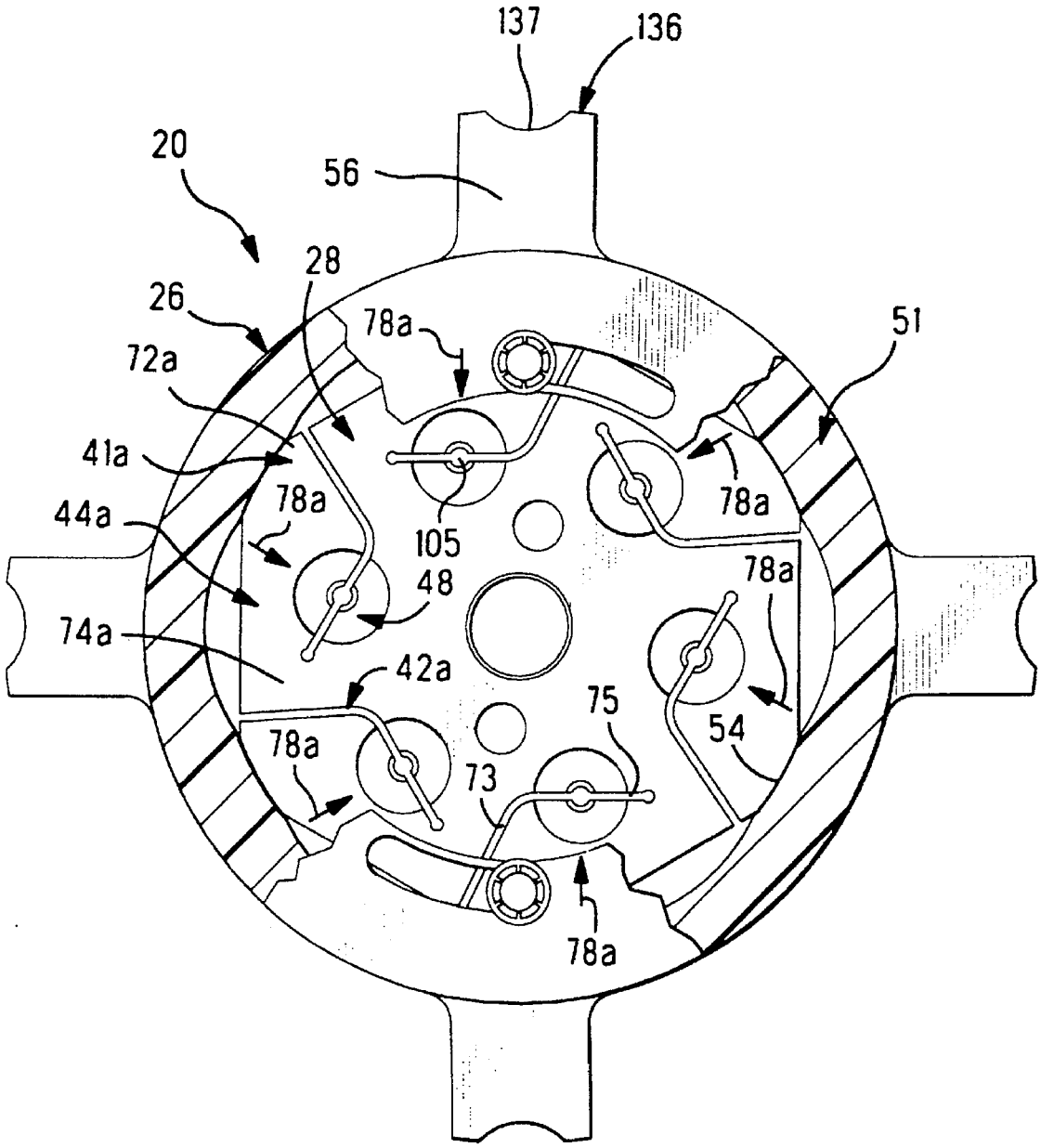
FIG. 10 is a partial fragmentary, cross-sectional, top plan view similar to the views as shown in FIGS. 3 and 4 and which illustrate an alternate embodiment of the present invention which employs non-linear slots.

Based on the present description, it should be appreciated that the slot 42 may have alternate configurations (such as is shown in FIG. 10 and described hereinafter in greater detail) and that the present invention includes these alternate embodiments.

The oblique, generally symmetrical sectional configuration of the clamping assemblies 41 allow a plurality of slots 42 to be spaced around the polygonal holder plate 28 defining a plurality of beams 44. At least one connector receiving nest 48 is associated with each slot 42 to retain a portion of an optical fiber connector 49 such as a ferrule 50 therein.

The articles being retained in the clamping assemblies 41 are described herein as optical fiber connectors. More specifically, the ferrules 50 of the connectors 49 are clamped in the clamping assemblies 41 to retain the connectors 49 on the plate while an exposed end of the ferrule 50 is polished. Such ferrules may be formed of ceramic, stainless steel, polymer or other materials. Other articles, having a generally axial orientation may be clamped in the clamping assemblies 41 so that exposed ends thereof may be polished. Further, the connectors are shown herein to be oriented generally perpendicular to the polishing machine. However, the connectors, more specifically the ferrules may be oriented at an angle relative to the polishing surface to achieve an angle polish.

The beams 44 are deflectable generally inwardly relative to the corresponding slot 42 by activation of a cam assembly 51 which has components positioned on the perimeter 30 of the holder plate 28 and the internal rim 32 of the cam ring 26. The cam assembly 51 includes a force receiving body in the form of generally convex cam surfaces 52 formed on the perimeter 30 of the holder plate 28 and a force transmitting body in the form of corresponding working surfaces 54 formed on the internal rim 32. Operation of the cam ring 26 relative to the holder plate 28 transfers forces by way of the cam assembly 51 in which the working surfaces 54 engage and drive against the cam surfaces 52 to impose clamping forces on the corresponding beams 44 to inwardly deflect the beams thereby clamping a connector in the nests 48.

Figure 9:
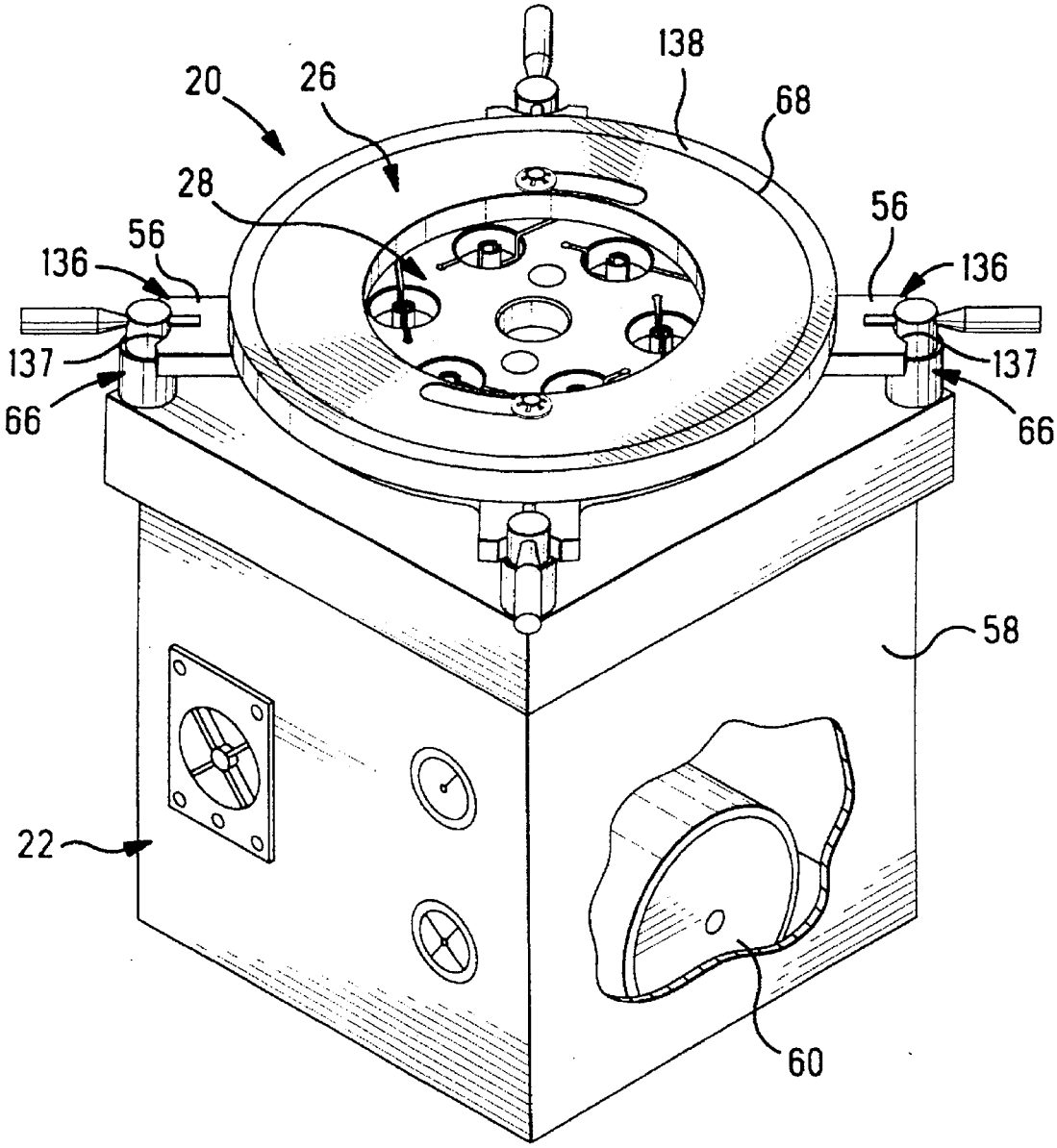
FIG. 9 is a perspective view of the fixture retained on the polishing machine with a weight collar positioned on the fixture on an outer portion of the cam ring and resting upon the arms.

Referring to FIGS. 1 and 9, the fixture 20 includes a plurality of arms 56 extending therefrom for mounting the fixture 20 on the polishing machine 22. The polishing machine 22 includes a housing or frame 58 to which a drive motor 60 is attached. The drive motor 60 operates a moveable table 62 which generally moves an abrasive surface 64 positioned thereon relative to the fixture 20 when the fixture 20 is positioned on the machine 22. Movement of the abrasive surface 64 relative to the fixture 20 provides a polishing action to polish the ends of the portions of the connectors, such as a ferrule, retained in the nests 48.

Attachment of the fixture 20 to the machine 22 is facilitated by fixture locating assemblies 66 positioned at outer edges of the machine 22 as shown in FIGS. 1 and 9. The fixture locating assemblies 66 as shown in FIGS. 1 and 9 are of a known construction and other configurations of the fixture locating assemblies 66 may be used with the present invention. In the configuration of the machine 22 and fixture 20 as shown in FIGS. 1 and 9, support structures in the form of four arms 56 are provided on the fixture 20 extending generally from an outer edge 68 of the cam ring 26. Each of these arms 56 is positioned on a shoulder 67 on the upper end of a post 69 of the corresponding fixture locating assembly 66 which orient the fixture 20 relative to the moveable table 62 and polishing surface 64. Spring loaded clamps 71 may be used to retain the arms 56 on the fixture locating assemblies with a downward force. Further description of the fixture locating assemblies 66 and attachment of the fixture 20 thereto is provided hereinbelow with the description of other aspects of the present invention.

Having briefly described the overall configuration of the fixture 20 and its relationship to a polishing machine 22, further reference is made to the specific structures and functions of the fixture 20 along with the materials used to form the fixture 20, the set up of the fixture, and the method associated with the present invention. In a preferred embodiment of the present invention, the cam ring 26 and connector holder plate 28 are formed of a polymer material. Each of the components, the cam ring 26 and connector holder plate 28 are integrally formed as a single piece body of a polymer material. Alternatively, a polymer material or other material may be machined to achieve the desired configurations of the cam ring 26 and the connector holder plate 28. Polymer material has been selected in a preferred embodiment in order to provide desirable elastic properties which are exploited during the set up and clamping of connectors in the connector holding plate 28. Further, use of polymer molded components will reduce the cost and increase the manufacturability of the fixture 20.

With reference to FIGS. 1–9, the connector holder plate 28 is shown as having six clamping assemblies 41, each one including a slot 42, a beam 44 and a nest 48. The clamping assemblies 41 are generally symmetrically and obliquely oriented slanting or sloping inwardly from the perimeter 30 of the plate 28. In this configuration, a leading end 72 of each beam is juxtaposed relative to a root end 74 of a neighboring beam 44. The slots 42 are generally formed along a non-diametric chord 76 extending from the perimeter 30. This arrangement of the slots 42 and the nests 48 positioned therealong result in a clamping assembly 41 which clamps connectors by the use of perimeter imposed inward clamping forces as represented by the force arrows 78 (shown in FIG. 5) which impose forces generally perpendicular to the chord 76 as a result of the operation of the cam assembly 51.

FIG. 10 shows a second embodiment of the invention. The embodiment as shown in FIG. 10 is different from the embodiment shown in FIGS. 1–9 such that the clamping assemblies 41a shown in FIG. 10 have a non-linear slot 42*a* extending from the perimeter 30 and through the nest 48. The other structures as shown in FIG. 10 are substantially identical to those as shown in FIG. 1–9. In describing the embodiment of the invention as shown in FIG. 10, structures which are identical to those as shown in FIGS. 1–9 will be identified by the same reference numerals and structures which are similar to or slightly different from the structures as shown in FIGS. 1–9 will be represented by the same reference numeral with the addition of an alphabetic suffix. For example, the clamping assemblies in FIG. 10 are referred to herein by reference numeral 41"*a*".

In FIG. 10, the clamping assemblies 41*a* are generally symmetrically arranged on the connector holder plate 28. Each clamping assembly 41*a* includes a slot 42*a*, a beam 44*a* and a nest 48. It can be seen that the nest 48 is generally identical to the nest 48 as shown in FIGS. 1–9 with the slot 42*a* extending from the perimeter 30 inwardly and through the nest 48. However, the slot 42*a* shown in FIG. 10 is different from the slot 42 shown in FIGS. 1–9 because the slot 42*a* is non-linear. The slot 42*a* includes a first segment 43 and a second segment 75. The first and second segments 73, 75 are angled relative to one another with the first segments 73 of each of the plurality of clamping assemblies 41*a* extending along a generally non-diametric chord and the second segments 75 extending generally parallel to a tangent of the perimeter 30.

The orientation of the slots 42*a* results in a beam 44*a* having a different configuration from that as shown in FIGS. 1–9. The beam 44*a* of each clamping assembly 41*a* includes a lead end 72*a* juxtaposed relative to the root end 74*a* of a neighboring beam 44*a*. The second embodiment of the clamping assembly 44*a*, similar to the first embodiment, clamps connectors by imposing clamping forces on the perimeter 30, as represented by force arrows 78*a*, to deflect the beam 44*a* inwardly. These forces are imposed substantially perpendicular to the second segment 75 of the slot 42*a* as a result of the operation of the cam assembly 51. It should be noted that the cam assembly 51 operates in generally the same manner as that described hereinabove with regard to the first embodiment as shown in FIGS. 1–9. The forces (78*a*) imposed on the nest 48 in the second embodiment are slightly different than the first embodiment such that the forces are substantially perpendicular to the second segment 75, and thus the nest 48, and are positioned more centrally relative to the nest 48.

Figure 4:
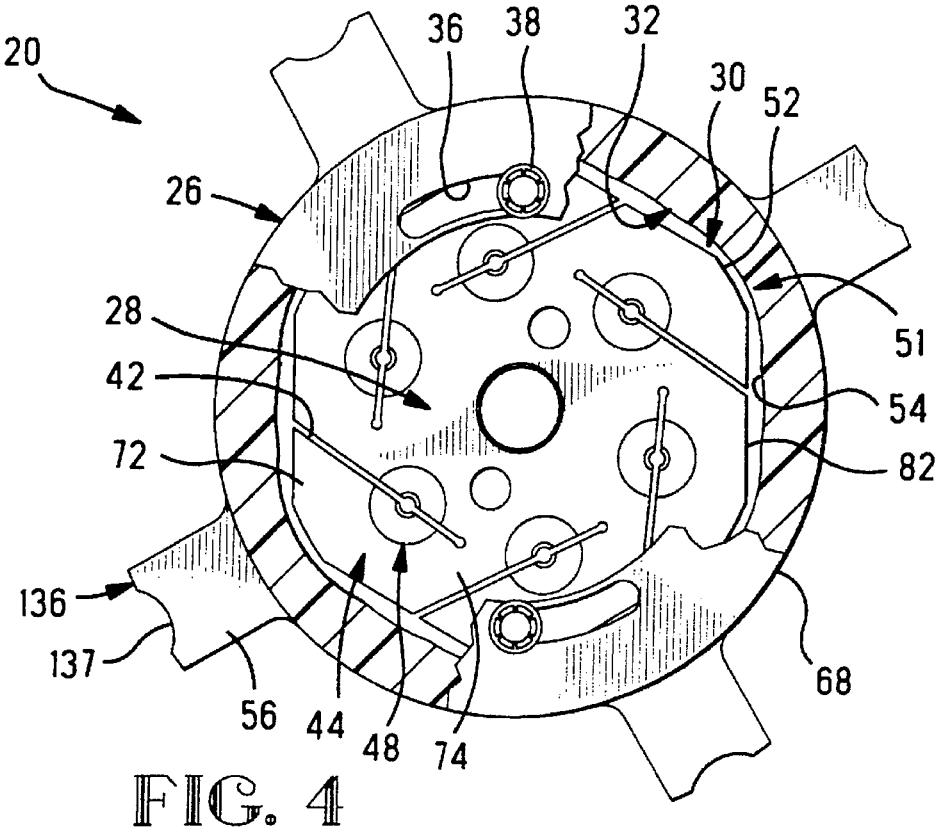
FIG. 4 is a partial fragmentary, cross-sectional, top plan view of the cam ring the holder plate showing cooperative working surfaces on the cam ring and cam surfaces on the holder plate and in which the working surfaces and the cam surfaces are not engaged.
Figure 5:
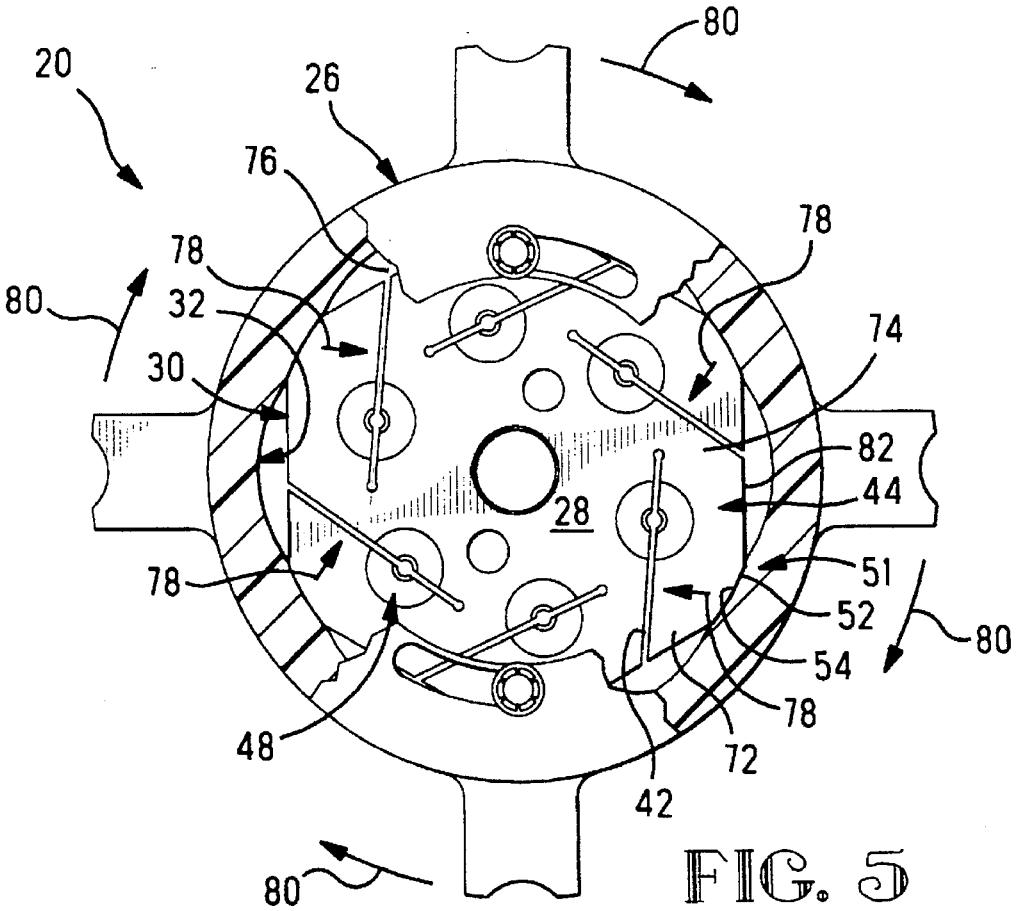
FIG. 5 is a partial fragmentary, cross-sectional, top plan view similar to FIG. 4 in which the cam ring has been rotated clockwise to engage the cooperative working surfaces and cam surfaces to impose clamping forces on the clamping assemblies.

Referring once again to the first embodiment as shown in FIGS. 1–9, FIG. 4 shows the fixture 20 in a open or released position in which the working surfaces 54 of the ring 26 are not engaged with the convex cam surfaces 52 of the holder 28. FIG. 5 shows the resultant engagement of the cam assembly 51 when the ring 26 is rotated (see direction of rotation arrows 80 as shown in FIG. 5) to drive the working surfaces 54 against the cam surfaces 52. The perimeter forces 78 impose generally perpendicular forces on the nests 48 by deflecting each beam 44 at the root end 74. All of the beams 44 are deflected generally simultaneously as a result of the equidistant and generally symmetric spacing of the components of the cam assembly 51. Further, since the components of the cam assembly 51 are positioned on opposing surfaces of the plate 28 and the ring 26, and rotation of the ring 26 relative to the plate 28 produces the clamping action, such action will occur regardless of the number of clamping assemblies 41. In this regard, while six clamping assemblies are shown, more or fewer clamping assemblies may be arranged in a similar fashion on a connector holder plate 28. Further, while linear sections 82 are shown extending between the convex cam surfaces 52, other contours of such sections may be used as long as the contour promotes movement when the ring 26 is rotated relative to the plate 28.

Additionally, while it is shown that a convex cam surface 52 is positioned on the corners or apices of the polygonal plate 28, other structures may be used to achieve the camming function of the cam assembly 51. In this regard, the working surfaces 54 may be disposed upon the plate 28 with cam surfaces 52 being disposed upon the internal rim 32 of the ring 26. The primary objective of the present invention is to provide a plurality of clamping assemblies 41 which are simultaneously operable by way of a cam assembly 51.

Figure 6:
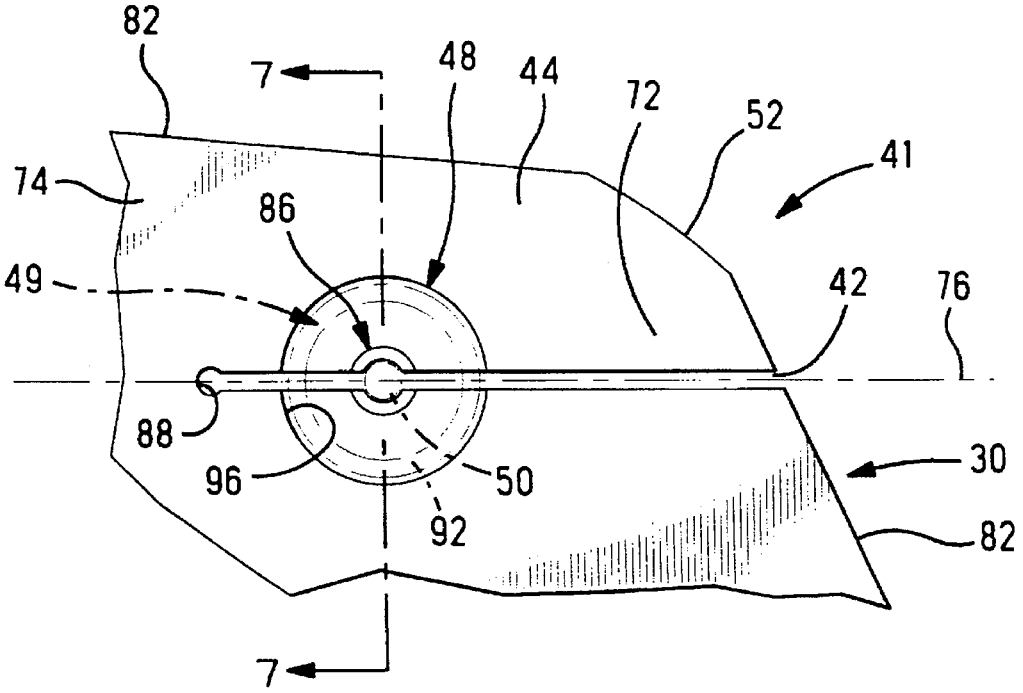
FIG. 6 is an enlarged partial fragmentary, top plan view of one of a plurality of clamping assemblies circumferentially positioned on the holder plate as shown in FIG. 2 showing a connector receiving nest in which is positioned a connector shown in phantom line, a slot extending obliquely from a perimeter of the holder plate and through the nest, and a cantilevered beam positioned between the perimeter edge of the holder plate and the slot.

Connectors 49 are only shown in FIG. 6 (and phantom line) 7 and 8 in the interest of clarity. Connectors 49 have been removed from FIGS. 1–5 and 9 since the connectors 49 and the ferrules 50 extending therefrom would obscure the view of the structures of the present invention and thereby interfere with a clear description. It is believed that the representation of the portions of the connectors 49 in FIGS. 6–8 provide sufficient disclosure of the interaction between the connector 49 and the fixture 20 for one having ordinary skill in the art to understand the present invention.

Figure 7:
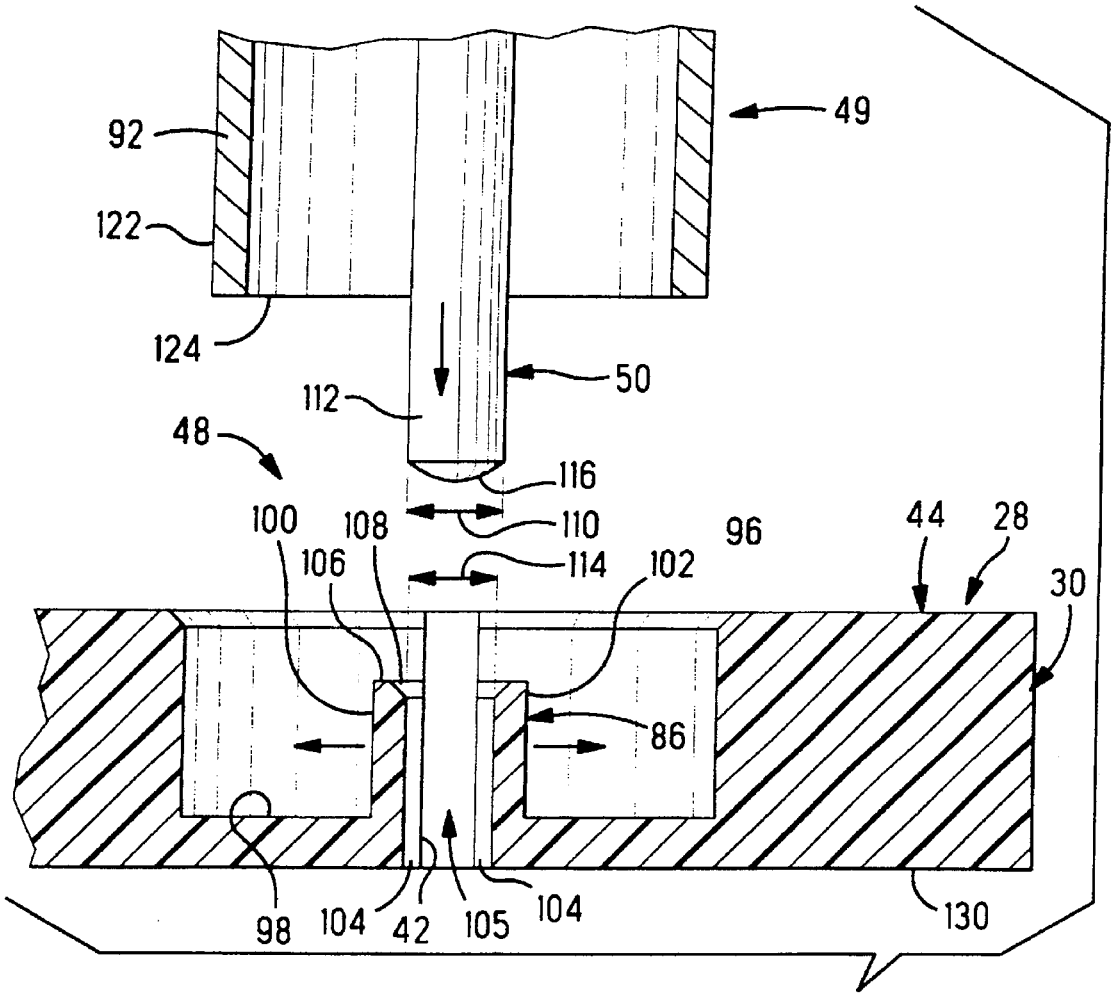
FIG. 7 is a partial fragmentary, cross-sectional, side elevational view taken along line 7—7 in FIG. 6 showing a connector (the connector is illustrated in the nest in FIG. 6) positioned for engagement in a split barrel of the clamping assembly.
Figure 8:
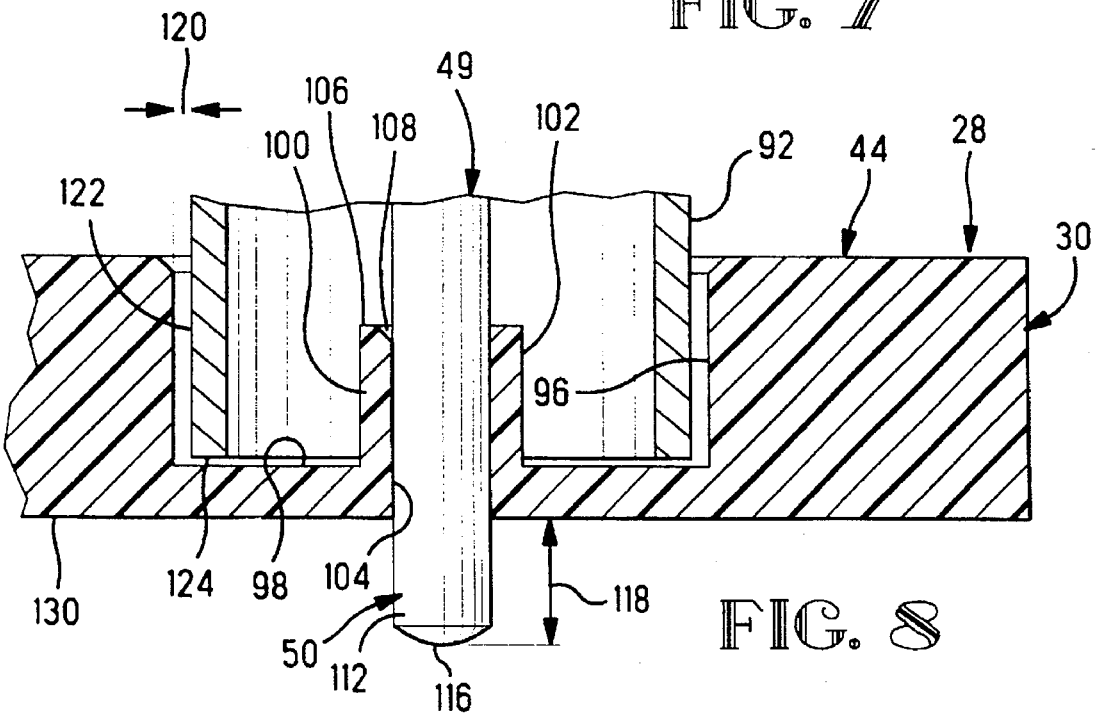
FIG. 8 is a partial fragmentary, cross-sectional, side elevational view of the connector positioned in the clamping assembly with ferrule of the connector retained in the split barrel.

Turning now to a further description of the clamping assemblies 41 and the nests 48 therein, reference is made to FIGS. 6–8 which show an enlarged plan view (FIG. 6) and partial fragmentary cross-sectional elevational views (FIGS. 7 and 8). In FIG. 6, the clamping assembly 41 includes the slot 42 extending from the perimeter 30 inwardly towards the nest 48. The camming surface 52 is located on the leading end 72 of the beam 44 with linear sections 82 extending therefrom.

The slot 42 extends through the nest 48 bisecting a split barrel structure 86 positioned centrally in the nest 48. The slot 42 extends beyond the nest to an enlarged terminus 88. The enlarged terminus 88 is a generally hollow, cylindrical structure which helps to minimize material fatigue created by deflection of the beam 44 during frequent clamping cycles.

In FIG. 6, the connector 49 is represented in phantom line showing a phantom representation of a housing 92 and the ferrule 50 positioned in the split barrel portion 86. The connector structures 49, 92, 50 are more clearly shown in FIGS. 7 and 8. In FIG. 7, the connector 49 is positioned for engagement with the nest 48, whereas in FIG. 8, the connector 49 is positioned in the nest 48 and the ferrule 50 is clamped by the split barrel 86.

The split adapter barrel 86 extends upwardly from the base and is divided by the slot 42 extending therethrough. The slot divides the barrel 86 into two generally arcuate wall sections 100, 102. The wall sections 102, 104 have internal surfaces 104 which define a precision bore 105 extending through the split barrel 86. An upper end 106 of the walls 100, 102 is formed with a beveled surface 108 adjoining the internal surfaces 104.

As shown in FIG. 7, an external diameter 110 of the ferrule 50, measured across an external surface 112 of the ferrule 50, is slightly greater than an internal diameter 114 measured between the internal surfaces 104 of the split barrel 86. The difference between the diameters 110, 114 results in a slight interference fit between the external surface 112 of the ferrule 50 and the internal surface 104 of the barrel 86. This interference fit created by the differential of the diameters 110, 114 captivates the ferrule 50 of a connector 49 in a corresponding nest 48 when the fixture 20 is being set up prior to polishing. To achieve the slight interference fit, the plate 28 is formed with the split barrel 86 and the slot 42 to provide a slightly smaller internal diameter 114 than the smallest diameter of the range of diameters of the ferrules to be received therein. In other words, the present invention is dependent on the size of the ferrule to be retained in the clamping assembly, although the clamping assembly will captivate a range of ferrule sizes and will accommodate variations in manufacturing tolerances. As described hereinbelow, while the present invention is dependent on the size of the ferrule, it is functions generally independent of the size of the other components of the connector.

Additionally, the beveled surface 108 on the entry end 106 promotes entry of a tip end 116 into the precision bore 105 and facilitates initial outward separation of the walls 100, 102. Further, the use of a polymer material to form at least the split barrel 86 and generally the entire fixture 20 prevents damage to the tip end 116 of the ferrule 50 which drives against the beveled surface 108 prior to positioning the ferrule 50 in the barrel 86. Any minor surface defects created during the insertion of the ferrule 50 will be removed during the polishing process.

Once the ferrule 50 is located in a desired position in the split barrel 86 taking into consideration the type of machine, the forces to be applied to achieve the desired polishing results and other variable associated with the polishing techniques to be employed, the clamp assembly 41 is activated by operating the ring 26. While there is a slight interference fit resulting from the dimensional difference between the ferrule 50 and the split barrel 86, activation of the clamping assembly 41 imposes increased clamping forces on the outside surface 112 of the ferrule 50 to securely retain the ferrule in the corresponding nest 48 during the polishing process. It should be noted that the dimensions of the recess of the nest 48 provide a clearance (120) between an outside surface 122 of the housing 92 and the recess wall 96. Further, a face edge 124 does not abut or bottom out against the bottom of the recess 98. The position of the tip 116 in the clamped position (as shown in FIG. 8) is determined during the set up process based on the configuration of the set up plate 24 (see FIG. 2).

With further reference to FIG. 2, the holder plate 28 is positioned over locating members or positioning posts 126 which align the precision bore 105 of each nest 48 with a corresponding clearance aperture 128 formed in base 129. The clearance apertures 128 are of sufficient diameter to receive a fiber stub extending from the ferrule 50. Additional details of the set up plate and the set up procedure for a polishing fixture are incorporated by reference to U.S. patent application Ser. No. 08/337,585, filed Nov. 10, 1995, entitled "Universal Polishing Plate for Polishing Machine" and assigned to the assignee of the present invention.

In use, the fixture 20 is positioned on the base 129 of the set up plate 24 such that the locating members 126 extend through corresponding positioning bores 132 formed through the plate 28. The cam ring 26 is positioned relative to the plate 28 in the unlocked position as shown in FIG. 4. In the unlocked position, the clamping assembly 41 is disengaged thereby relieving clamping forces from the clamping assemblies 41. Connectors may be inserted through a central entrance 134 of the ring 26. The connectors 49 are then positioned in respective nests 48 with an external surface 112 of each ferrule 50 abutting an internal surface 104 of a corresponding precision bore 105 of the split barrels 86. Engagement of the ferrule 50 with the corresponding split barrel 86 forces the walls 100, 102 slightly outwardly as the tip 116 of the ferrule is forced over the beveled surface 108.

The interference fit between the internal surface 104 of the barrel 86 and the external surface 112 with the ferrule 50 captivates each connector 49 in the corresponding nest 48 while the remaining connectors 49 are being positioned. Once all of the connectors are inserted into the fixture, the ring 26 is rotated (see FIG. 5) to activate the cam assemblies 41. Activation of the cam assemblies 41 forces the working surfaces 54 against the cam surfaces 52 to deflect the beams 44 inwardly. The inward deflection of the beams 44 imposes additional clamping forces between the barrel 86 and the ferrule 50 to securely retain the ferrule at the desired extension 118 as determined by the set up plate 24. The cam assemblies 51 are simultaneously activated due to the structure of the plate 28 and ring 26 and the generally equidistantly spaced configuration of the clamping assemblies 41. The forces created during the activation of the cam assemblies 51 retain the ring and plate 26, 28 in the locked position as shown in FIG. 5.

The locked fixture 20 is then removed from the set up plate 24 and moved to a machine 22 for polishing. The arms 56 are positioned relative to the fixture locating assemblies 66 with a distal end 136 of the arms resting on the shoulder 67 of the assemblies 66. A recess 137 on the distal end 136 couples with a corresponding outside surface of the assembly 66 for maintaining the position of the fixture 20 relative to the moveable table 62.

The weight of the fixture 20, its position relative to the polishing surface 64, the length which the ferrules 50 extend from the fixture, as well as other variables will result in a net force on the tips 116 of the ferrules 50. Depending on the polishing process, it may be desirable to controllably adjust the net force on the tips 116 of the ferrules 50. While the fixture 20 may not need to be clamped into position on the machine 22, the spring loaded clamps 71 of the fixture locating assemblies 66 may be used to apply downward forces to the fixture 20. Similarly, weights may be applied to the fixture 20 to produce a predetermined net force on the ferrules 50.

With reference to FIG. 9, a weight 138 is added to the fixture 20 to provide a downward force which also counteracts the uplifting force created by the ferrules 50 positioned against the abrasive surface 64. Controlled application of additional forces may be provided by use of a weight 138, spring loaded clamps 71 or a combination of the weight 138 and the clamps 71. Application of additional forces on the fixture 20 may be beneficial when the fixture of the present invention is formed of a polymer material because the polymer material may be considerably lighter than the same fixture formed of metal. When a weight 138 is used, the weight 138 is positioned over the fixture 20 generally surrounding the ring 26. This arrangement of the weight 138 positions the forces produced by the weight in close proximity to the connector to provide a generally equal distribution of the weight to provide a generally equal weight force on each of the connectors.

With regard to materials for the present invention, it has been discussed hereinabove that a polymer material is preferred to facilitate use of a molding operation to manufacture the ring and plate of the fixture. In this regard, it has been determined that it is desirable to use a material such as Acetron® NS, produced by the Polymer Corporation, for use in the cam ring for both an injection molded embodiment, as well as, a machined embodiment. The holder and set up plate may be formed of a material such as Acetron® GP also manufactured by the Polymer Corporation, for a machined structure of the holder and set up plate or Delrin® 100P, manufactured by E. I. DuPont Corporation, for an injection molded version of the holder and set up plate.

The selected materials have a high degree of dimensional stability and ease of manufacturability. Additionally, such polymer materials have a desirable and compatible coefficients of friction which promote the operation of the cam assemblies 51. Material used in the holder is different for a machined article as compared to an injection molded article since the machine operation will undergo slightly different manufacturing forces. In either case, the selected holder materials have spring properties which allow deflection of the beams upon operation of the cam assemblies. The Acetron® NS used in the cam ring contains solid lubricants fillers which have a lower coefficient of friction which produce desirable wear characteristics and operation of the cam assemblies.

While a preferred embodiment of the present invention is shown and described, it is envisioned that those skilled in the art may devise various modifications and equivalents without departing from the spirit and scope of the appended claims. The invention is not intended to be limited by the foregoing disclosure.

The invention claimed is:

1. A polishing fixture for polishing articles retained in said fixture, said fixture comprising:

an article holding plate having at least one edge;

a plurality of slots in said holding plate extending from said edge into said holding plate;

a plurality of clamping assemblies, each of said clamping assemblies including a movable beam between each of said plurality of slots and a corresponding portion of said edge; and a force transmitting body and a force receiving body coupled with said fixture for imposing forces on said clamping assemblies to move said beams to clamp portions of said articles in said clamping assemblies.

2. A polishing fixture as recited in claim 1, said force transmitting body and said force receiving body comprising:

said force transmitting body having a rim positioned relative to said edge; and a cam assembly retained on said holding plate and said force transmitting body for imposing forces on said clamping assemblies to move said beams to clamp portions of said articles in said clamping assemblies.

3. A polishing fixture as recited in claim 2, said cam assembly further comprising:

a plurality of convex cam surfaces positioned on said edge of said holding plate and a corresponding plurality of working surfaces positioned on said rim of said force transmitting body for operation against said cam surfaces, said cam surfaces and said working surfaces providing a mechanical advantage for deflecting said beams to clamp said portions of said articles positioned in corresponding ones of said slots.

4. A polishing fixture as recited in claim 1, wherein said slots are oriented along a non-diametric chord of said holding plate and extend generally obliquely through said holding plate.

5. A polishing fixture as recited in claim 1, wherein said slots are oriented along a non-linear path through said holding plate and extend generally obliquely through said holding plate.

6. A polishing fixture as recited in claim 1, each of said clamping assemblies further comprising:

a connector retaining nest positioned in said slot for retaining a portion of said connector on said holding plate relative to said slot and said beam, said nest including a clamping portion for abutting an outside surface of a portion of said connector retained therein, forces imposed on said beam by activation of said cam assembly transferring clamping forces to said clamping portion of said nest to retain said connector therein.

7. A polishing fixture as recited in claim 6, wherein each of said clamping assemblies includes said beam being positioned for providing an initial clamping force on said portion of said connector retained in said nest, said nest having internal surfaces for abutting said portion of said connector to be retained in said nest, a diametral dimension of said nest measured across said internal surfaces is less than a corresponding diametral dimension of a portion of said connector to be retained in said nest, said diametric difference providing an interference force for retaining said connector in said nest prior to being clamped by said operation of said cam assembly.

8. A polishing fixture as recited in claim 6, wherein said portion of said connector retained in said nest is a ferrule and leading edges of said internal surfaces of said nest are beveled for facilitating initial engagement of a tip of said ferrule with said internal surfaces.

9. A polishing fixture as recited in claim 1, further comprising:

posts extending from said holding plate;

said force transmitting body having elongated apertures formed therein positioned for engagement with said posts; and retainers being attached to an end of said posts extending from said elongated apertures for retaining said holding plate in assembly with said force transmitting body and allowing movement of said force transmitting body relative to said holding plate along said elongated apertures.

10. A polishing fixture as recited in claim 1, wherein said holding plate is a generally polygonal body, said force transmitting body is a ring structure having an rim formed in a complementary polygonal shape for cooperatively fitting with said polygonal shape of said holding plate, and said cam assembly includes cam surfaces positioned on said perimeter of said polygonal plate relative to said beams and working surface positioned on said rim for engaging said cam surfaces when said ring shaped force transmitting body is rotated relative to said holding plate.

11. A polishing fixture as recited in claim 1, further comprising support structures depending from one of said holding plate and said force transmitting body for attaching said polishing fixture to a polishing machine.

12. A polishing fixture as recited in claim 1, further comprising a weight positionable on said fixture for increasing the forces on said portions of said articles positioned against a polishing surface on said polishing machine, said weight being generally equidistantly spaced from each of said portions retained on said holding plate for imposing generally equal weight forces of each of said portions retained therein.

13. A polishing fixture as recited in claim 1, wherein said holding plate and said force transmitting body are each integrally molded from a polymer material.

14. A polishing fixture for use with a polishing machine which polishes ferrule portions of optical fiber connectors retained in said fixture, said fixture comprising:

a connector holding plate having a generally polygonal perimeter edge, corners of said holding plate having convex cam surfaces disposed thereon, generally linear portions of said polygonal perimeter extending between said curved corners;

a plurality of slots formed in said holding plate extending obliquely from said linear portions of said polygonal perimeter of said holding plate, said plurality of slots being generally equidistantly spaced in a circumferential area of said holding plate;

a movable beam being defined between each of said slots and a corresponding portion of said polygonal perimeter, said beam being inwardly deflectable relative to said polygonal perimeter for providing clamping forces to retain one of said ferrules positioned in said slot; and a cam ring positioned around said holding plate, said cam ring having a complementary polygonal rim, said rim defining working surfaces for engaging said convex cam surfaces on said holding plate and imposing forces thereon when said cam ring is rotated relative to said holding plate to deflect said beams inwardly to clamp said ferrule positioned in said slot.

15. A polishing fixture as recited in claim 14, wherein said holding plate and said cam ring are each integrally molded from a polymer material.

16. A polishing fixture as recited in claim 14, wherein said holding plate and said cam ring are formed of a polymer materials having: spring characteristics which facilitate deflection of said beam; wear resistant characteristics which allow repeated rotations of said cam ring and said holding plate to operate said working surfaces of said rim against said convex cam surfaces of said perimeter; and friction characteristics which minimize the friction between said cam ring and said holding plate to facilitate clamping while providing sufficient friction to maintain a desired clamped position.

17. A polishing fixture as recited in claim 14, said cam ring further comprising:

a plurality of arms extending outwardly from an outer portion of said cam ring, said arms being connectable to said polishing machine for positioning said fixture on said polishing machine.

18. A polishing fixture as recited in claim 14, each of said clamping assemblies further comprising:

a connector retaining nest for retaining a connector on said holding plate, said nest including a clamping portion having internal surfaces for abutting an external surface of said ferrule retained in said fixture.

19. A polishing fixture as recited in claim 14, further comprising: said beam being positioned for providing an initial clamping force on a ferrule retained in said nest.

20. A polishing fixture as recited in claim 14, further comprising:

a connector retaining nest positioned in said slot between said beam and said holding plate, said nest having internal surfaces for abutting a portion of said connector to be retained in said nest, a diametral dimension of said nest measured across said internal surfaces being less than a corresponding diametral dimension of a portion of said connector to be retained in said nest, said diametric difference providing an interference fit between said ferrule and said nest for retaining said ferrule in said nest prior to being clamped by said cam ring.

21. A polishing fixture as recited in claim 14, further comprising a generally toroidal weight positionable on said fixture for increasing the forces on said connectors against a polishing surface on said polishing machine, said toroidal weight being positionable over said fixture generally surrounding said cam ring, said weight being generally equidistantly spaced from each of said nests for imposing generally equal weight forces of each of said connectors retained in each of said nests.

22. A method of retaining a plurality of optical fiber connectors in a polishing fixture for use with a polishing machine which polishes optical fiber connectors retained in said fixture, said method comprising the steps of:

providing a connector holding plate having a plurality of slots extending generally obliquely inwardly from a perimeter edge through said holding plate, a clamping assembly being associated with each of said plurality of slots, a force transmitting body having an internal rim positioned around said perimeter edge, a cam assembly positioned on said perimeter edge and said internal rim for simultaneously operating said clamping assemblies;

positioning a connector in a corresponding one of said clamping assemblies;

moving at least one of said holding plate and said force transmitting body for activating said cam assemblies; and activating said cam assemblies for simultaneously clamping the connectors retained in said clamping assemblies.

23. A method of retaining a plurality of optical fiber connectors in a polishing fixture as recited in claim 22, further comprising the steps of:

providing a deflectable beam of said clamping assembly, said deflectable beam being defined between said slot and a corresponding portion of said perimeter of said holding plate; and preloading said beam for providing an interference fit between a portion of a connector positioned in said clamping assembly and an abutting surface of said clamping assembly to retain said connectors in said nests prior to being clamped therein by operation of said cam assembly.

24. A method of retaining a plurality of optical fiber connectors in a polishing fixture as recited in claim 22, further comprising the steps of:

applying weight to said fixture for increasing forces on portions of each of said connectors positioned against a polishing surface of said polishing machine.

25. A polishing fixture in combination with a polishing machine which polishes generally axially oriented articles, such as optical fiber connectors, retained in said fixture when said fixture is attached to said machine; said optical fiber connectors having a ferrule; said machine having a frame, a drive motor attached to said frame, a polishing device operatively associated with said frame and driven by said drive motor, and fixture retainers depending from said frame; said fixture comprising:

an article holding plate at least one edge;

a plurality of slots formed in said holding plate extending from said edge through said holding plate;

a plurality of clamping assemblies, each of said clamping assemblies including a deflectable beam being defined between each of said plurality of slots and a corresponding portion of said edge;

a force transmitting body having a rim positioned relative to said edge; and a cam assembly retained on said holding plate and said force transmitting body for imposing forces on said clamping assemblies to deflect said beams to clamp said ferrules of said connectors in said clamping assemblies.

* * * * *